United States Patent [19]

Asher et al.

[11] 4,077,181

[45] Mar. 7, 1978

[54] INSERTING APPARATUS

[75] Inventors: Leslie K. Asher, Norwalk; Charles E. Gibson, Greenwich; Frank T. Roetter, Westport, all of Conn.

[73] Assignee: Pitney-Bowes, Inc., Stamford, Conn.

[21] Appl. No.: 698,168

[22] Filed: Jun. 21, 1976

[51] Int. Cl.[2] ..... B65B 65/08; B65B 5/06; B65B 35/54; B65B 63/02

[52] U.S. Cl. ..... 53/78; 53/124 TS; 53/154; 53/159; 53/266 A

[58] Field of Search ..... 53/266 A, 61, 62, 116, 53/117, 124 CC, 124 TS, 124 R, 154, 78, 159, 188, 189, 35, 24, 31, 29, 255, 257; 270/58, 68 A; 271/2, 3, 9; 235/89 R

[56] References Cited

U.S. PATENT DOCUMENTS

| | | | |
|---|---|---|---|
| 3,049,845 | 8/1962 | Hanson | 53/62 |
| 3,162,435 | 12/1964 | Rastorguyeff et al. | 271/2 |
| 3,508,067 | 4/1970 | Urbasch et al. | 270/58 X |
| 3,516,655 | 6/1970 | Schmeck | 270/68 A |
| 3,606,728 | 9/1971 | Sather et al. | 270/58 X |
| 3,935,691 | 2/1976 | Broch | 53/189 X |

*Primary Examiner*—Othell M. Simpson
*Assistant Examiner*—Horace M. Culver
*Attorney, Agent, or Firm*—Thomas R. FitzGerald; William D. Soltow, Jr.; Albert W. Scribner

[57] ABSTRACT

Apparatus for inserting a stack of items into an envelope. A plurality of bank checks are serially fed, counted, and stacked at a receiving and stacking station while simultaneously an envelope is fed to an insertion station. A counter visually displays the number of the counted checks and after a predetermined number have been fed, counted, and stacked, a bank statement is fed and folded and simultaneously an enclosure is fed to the stack of checks at the stacking station by pairs of endless transport belts. A document depressor exerts force downwardly upon the folded statement, enclosure, and plurality of checks, pressing those items into a compressed stack whereupon a ram carrying an adjustable finger moves forward between the document depressor and compressed stack of items. The finger carried by the ram abuts against the long edge of the stack to insert the stack into the envelope at the insertion station.

5 Claims, 3 Drawing Figures

INSERTING APPARATUS

BACKGROUND OF THE INVENTION

1. Field of the Invention

The present invention relates generally to improvements in inserting apparatus and more particularly pertains to a new and improved inserting apparatus for inserting a stack of documents consisting of a folded bank statement, an enclosure, and stack of checks into an envelope. Prior to insertion of the stack of documents into the envelope, checks are simultaneously counted and fed to a receiving and stacking station. After a predetermined number of checks have been counted, a bank statement is fed and folded and an enclosure is simultaneously fed to the stack of checks for insertion into the envelope.

2. Description of the Prior Art

In businesses or more particularly financial institutions where checks and statements delineating transactions of the checks are processed, it has been a general practice in the art to employ manual labor to manually count a predetermined number of checks to agree with a predetermined printed number of checks on the statement at which time the statement is folded to be inserted into an envelope along with the checks. Checks are usually withdrawn in bundles corresponding to individual accounts from a check storage drawer. The bundles are mated with their corresponding statements that are usually in a stack to be collated together with the checks. Then the folded statement and checks are usually manually inserted into the envelope, and sometimes, along with an additional enclosure such as an advertisement. Manual labor for insertion of a folded statement, an enclosure, and checks into an envelope has been unsatisfactory due to the expense of labor the tedious manual insertion time consumed and the errors caused by manual counting.

Those concerned with the development of automatic mechanization to accomplish the counting and stacking of checks in addition to folding and stacking of a statement onto a stack of counted checks have long recognized the need for a low cost insertion apparatus to accomplish the tasks of counting, stacking, folding, and insertion of checks and a corresponding statement into an envelope.

There are numerous machines manufactured that count a plurality of documents such as checks or currency; see, for example, U.S. Pat. No. 2,805,825; Sept. 10, 1957. There are also machines in the art that fold a single sheet such as a bank statement into halves or thirds so as to accommodate such prior to insertion into an envelope. In addition, there are machines that insert stacks of items into an envelope such as a prefolded statement and a plurality of checks.

In a patent issued to Hanson, U.S. Pat. No. 3,049,845, Aug. 21, 1962, an inserting apparatus collates into a stack a document from each of two hoppers along with an envelope from a third hopper. Then, a ram inserts the collated documents into the envelope. The inserting apparatus does not count a plurality of documents from any of the hoppers nor does it fold a document in half prior to collation with other documents for insertion into an envelope as does the invention of this application.

Some machines presently manufactured for collating a stack of a plurality of first items such as checks, a second item such as a folded statement, and a third item such as an advertising enclosure are expensive, large complex mechanical machines which can be purchased only by large financial institutions having a high volume of commercial accounts necessitating the utilization of this type of machine. These machines are complex in mechanical operation and require at least one if not more highly skilled trained operators to efficiently and effectively utilize the machine in its designated function.

This invention fills a need for a low cost table top in line inserting apparatus for inserting a stack of documents into an envelope which can be utilized by a single machine operator.

SUMMARY

The general purpose of this invention is to feed, count, and stack a plurality of checks at a receiving and stacking station, and after a predetermined number have been counted, a second document is fed and folded while simultaneously feeding a third document to the stacking station whereupon the stack of documents is inserted into an envelope at an insertion station.

The invention for inserting items into an envelope consists of apparatus to serially feed, count, and stack a predetermined plurality of first items such as checks to a receiving and stacking station. A visual resettable digital counter displays a count of the plurality of items. After a predetermined number of the first items has been counted and fed to the receiving and stacking station, and if this number displayed on the visual counter is in agreement with a predetermined printed number on a second item such as a bank statement, the second item is folded and fed to the stacking station. Thereupon, the stack of plurality of first items and the second item is inserted into an envelope at the insertion station. Between the in line structure for feeding a plurality of first items and a second item, a third item such as an advertising enclosure can be fed to the receiving and stacking station. Two pairs of endless transport belts feed the second and third items to the receiving and stacking station. A document depressor compresses the items downwardly at the receiving and stacking station while a ram moves between the document depressor and the compressed stack of items. The ram carries an adjustable finger to engage against the long end of the stack of compressed items to push them forward for subsequent insertion into an envelope at an insertion station.

An object of the present invention is the provision for inserting a stack of items into an envelope. The stack of items can consist of a plurality of first items such as bank checks, a second item such as a folded bank statement, and a third item such as an enclosure.

Another object is to count a predetermined plurality of first items while being serially fed and visually displaying this count on a resettable digital display. When a predetermined count has been reached and if this count number agrees with that appearing on, for instance, a second document such as a bank statement, the second and third items are simultaneously fed to the stack of the plurality of first items. The display counter is located near the second item for ease of operation in comparing the number of counted plurality of first items with the predetermined number printed on the second item. The second document, while being fed simultaneously with the third document, can be folded while being fed or prior to being fed.

A further object of the invention is the provision of a semi-automatic "folded bank statement — check counting — enclosure" envelope inserting apparatus suitable for use in small and medium size financial institutions. The inserter will insert an average monthly amount of checks into an envelope numbering in a range of up to fifty checks in addition to a folded statement and an enclosure such as an advertising brochure.

Still another object is to provide an inserting apparatus simple in operation so that it can be operated by one unskilled machine operator and low cost so that any small financial institution can effectively utilize this apparatus.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which the like references numerals designate like parts throughout the figures thereof and wherein.

DESCRIPTION OF THE PREFERRED EMBODIMENTS

Figure 1:
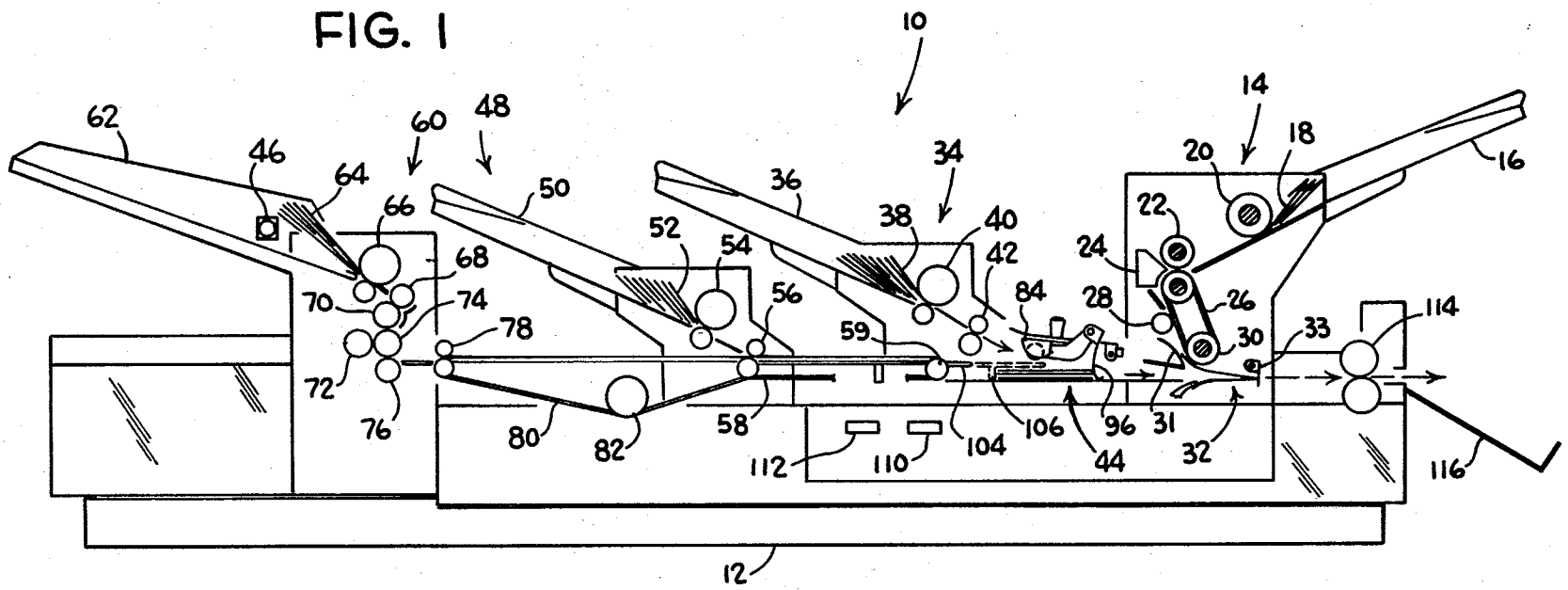
FIG. 1 illustrates a plan view of the preferred embodiment of the invention.

FIG. 1 which illustrates a preferred embodiment of the invention, shows a plan view of inserting apparatus 10 which mounts on support base 12.

An envelope feeding and flapping machine 14 which attaches to support base 12 having a hopper 16 to accommodate items such as envelopes 18. Envelopes 18 are fed through a pair of opposing separating rollers 20, a pair of guide and flapping rollers 22 past a flapper 24, and between an endless transport belt 26 and pressure roller 28 to a feed roller 30 whereupon the envelope is deposited at insertion station 32. The flap of envelope 18 is held open by flap open guide 31 and the bottom edge of envelope 18 abuts against envelope stop 33. Endless transport belt 26 connects between the lower roller of the opposing pair of guide and flapping rollers 22 and feed roller 30. This envelope feeding machine is similar to that disclosed in U.S. Pat. No. 3,162,435 issued to Rastorguyeff et al on Dec. 22, 1964, for engaging and folding back the bent over flap on an envelope, assigned to the same assignee as this invention.

A document counting and feeding machine 34 which attaches to support base 12 having a hopper 36 accommodates a plurality of first items 38 such as bank checks. Bank checks 38 are fed one at a time and counted through a pair of opposing separator rollers 40 and a pair of feed rollers 42 whereupon the checks are stacked at receiving and stacking station 44 against stop fingers 96 of document depressor 84 to be described later in detail. A resettable visual digital display counter 46 can be conveniently located adjacent to the document counting and feeding machine 34 or next to a document feeding and folding machine 60 and actuated by any suitable means well known in the art.

An enclosure feeding machine 48 which attaches to support base 12 having a hopper 50 accommodates third items such as enclosures 52. Items 52 are fed through a pair of opposed separating rollers 54 and a pair of opposed feed rollers 56 to endless transport belt 58 connected between transport belt roller 59 and the lower roller of opposed pair of feed rollers 56.

A document folding and feeding machine 60 which attaches to support base 12 having a hopper 62 accommodates a second item such as bank statements 64. Each second item 64 upon being separated and fed through a pair of opposed separating rollers 66 and feed roller 68, is folded between four folding rollers 70, 72, 74 and 76 thereupon being fed to feed rollers 78 and endless transport belt 80 connected between the lower roller of opposed pair of feed rollers 78 and 56 in addition to transport belt roller 82. The enclosure feeding and folding machine is similar to that disclosed in U.S. Pat. No. 3,510,122, issued to Gavagan for folding a sheet, assigned to the same assignee of this invention.

Figure 2:
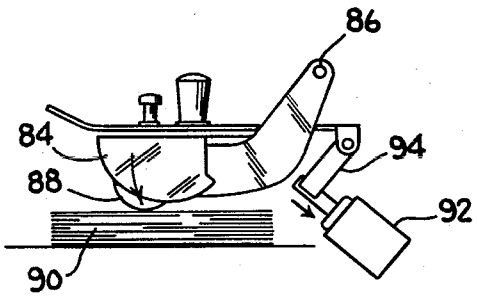
FIG. 2 illustrates a plan enlarged view of the document depressor section of the apparatus in an actuated condition.

FIG. 2 illustrates a plan view section of document depressor 84 in an actuated condition. Document depressor 84 which is axially rotatably mounted on shaft 86 compresses a stack of documents through an axially rotatable wheel 88 prior to insertion into an envelope 18 which is not shown. A solenoid 92 through actuation of a bar link 94 axially rotates document depressor 84 downward about shaft 86 thereby depressing stack documents 90 into least possible height.

Figure 3:
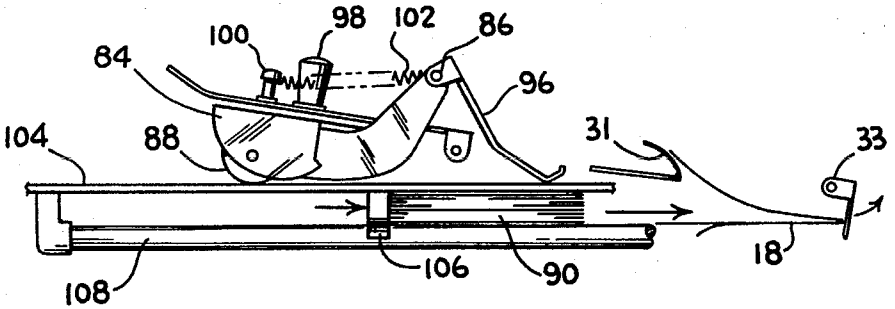
FIG. 3 illustrates a plan enlarged view of the document depressor section of the apparatus in an unactuated condition.

FIG. 3 illustrates a plan view section of document depressor 84 in an unactuated condition showing stop fingers 96, knob 98, adjustable spring tensioning screw 100, and spring 102. Adjustable spring tensioning screw 100 is slidably mounted in a longitudinal slot, not shown, in document depressor 84 to adjust the spring tension of stop fingers 96 which documents 38, 52, and 68 strike abut up against while being fed to receiving and stacking station 44. A ram 104 carrying adjustably mounted finger 106 guided by cylinder rod 108 engages up against the rear edge of the stack and carries the stack of documents 90 from receiving and stacking station 44 to an envelope 18 for insertion at insertion station 32. Finger 106 is adjustably affixed to ram 104 to accommodate different physical sizes of stacks of documents.

PREFERRED MODE OF OPERATION

The preferred mode of operation of inserting apparatus 10 is now described. Envelopes 18 are loaded into hopper 16 of envelope feeding and flapping machine 14 with the flaps of envelopes 18 oriented as shown in FIG. 1 of the drawing. A plurality of a first items 38 such as a bundle of checks associated with one account are removed from a storage drawer of a financial institution and loaded into hopper 36 of document feeding and counting machine 34. All the checks have been segregated into individual account bundles at the end of each month in drawers so that it is only necessary to place each individual bundle of checks one at a time, all theoretically associated with one account, into hopper 36. A plurality of enclosures such as advertisements 52, similar in size to that of a bank check and or to be accommodated at insertion by envelope 18, are loaded into hopper 50 of enclosure feeding machine 48. Finally, a plurality of items such as unfolded statements 64 are placed into hopper 62 of enclosure folding and feeding machine 60. Statements 64 should be in the same corresponding order as bundles of checks 38 and are loaded into hopper 36 of document feeding and counting machine 34.

In operation, a feed power 110 switch is energized to power a motor to drive endless transport belts 58 and 80. Simultaneously, a plurality of first items such as checks 38 are counted and fed to a receiving and stacking station 44 where the checks strike and abut up against stop fingers 96 of document depressor 84 deposed in the path of travel while being fed by document counting and feeding machine 34. When each of said plurality of first items 38 have been fed to receiving and stacking station 44, a count will be displayed on a resettable visual digital display counter 46 adjacent to enclosure folding and feeding mechanism 60. The count of the plurality of a first items, checks, 38 as displayed by counter 46 should tally and agree with a printed predetermined number of checks on a second item 64, statement, now positioned in hopper 62 at the pair of opposed separating rollers 66 of the document folding and feeding machine 60.

If counter 46 is not in agreement with the printed document number on the statement 64, then the checks are removed from stacking station 44 to be refed in the event of a miscount at which time counter 46 would be reset to zero prior to refeed. To remove the checks 38, knob 98 is lifted upwardly thereby axially rotating document depressor 84 upwardly around shaft 86 so that an operator can reach into receiving and stacking station 44 to manually remove the checks. If the number of checks 38 that are refed still is again in disagreement with the printed tally number on statement 64, then the plurality of checks 38 are removed from receiving and stacking station and statement 64 is removed from document folding and feeding machine 60 for additional study so as to determine the nature for the disagreement of the count of the fed plurality of first items, the checks 38, with the printed predetermined number of first items on the second document 64, the statement.

If counter 46 is in agreement with the printed document number on statement 64, then an insert switch 112 is actuated to energize the solenoid 92 depressing the wheel 88 against the top stack of checks to compress the stack as shown in FIG. 2. Insert switch 112 also actuates folding and feeding machine 60 which feeds, folds and conveys the second document, in this instance bank check statement 64 while simultaneously enclosure feeding machine 48 is feeding a third item, such as an enclosure 52 to document receiving and stacking area 44. Actuating the insert switch 112 also resets the counter 46 to zero for its next count. Transport belt 58 conveys enclosure 52 to receiving and stacking area 44 while transport belts 58 and 80 convey the folded statement 64 to stacking area 44 with the last remaining distance to stacking area 44 between the compressed stack of checks and wheel 88 of document depressor 84 being free flight after leaving transport roller 59 and belt 58. Envelope 18 is fed and flapped to insertion station 32 by envelope feeding and flapping machine 10 whereupon it abuts against envelope stop 33.

Then with plurality of a first items, checks 38, stacked with a third document, enclosure 52, and a second document, statement 64 which is now folded, in a justified and aligned stack 90 against stop fingers 96, ram 104 carrying finger 106 is moved forward guided by cylinder 108 between the top of the compressed stack 90 of documents at stacking station 44 and wheel 88. At this instance, solenoid 92 is deactuated and spring 102 pulls document depressor into the position as shown in FIG. 3. As ram 104 continues to move forward as shown by imaginary lines in FIG. 1, finger 106 engages the stack of documents 90 now held into compression by ram 104 as the stack is moved into envelope 18 at insertion station 32. Once the stack of documents is inserted into the envelope, ram 104 carrying finger 106 moves backwards outward of envelope 18 to its rest position as that shown in FIG. 1. Envelope 18, after having received insertion of stack 90, is discharged by feed rollers 114 to storage tray 116 by any suitable conveyor mechanism which are well known in the art. The circuitry for controlling these functions is not disclosed or claimed as such is well known and utilized in the art.

The operation is repeated in feeding checks 38, counting the checks on counter 46 to be in agreement with a predetermined printed number on statement 64; feeding and folding a statement while simultaneously feeding an enclosure to a stack of checks; and inserting stack 90 into an envelope 18 for as many bundles of checks that exist for each account corresponding to a respective equal number of bank statements.

Various modifications are contemplated and may obviously be resorted to by those skilled in the art without departing from the spirit and scope of the invention, as hereinafter defined by the appended claims, as only a preferred embodiment thereof has been disclosed.

What is claimed is:

1. Apparatus for inserting a plurality of items into an envelope comprising:

A. means for simultaneously inserting into an envelope a stack of a plurality of first items and a second folded item, B. means for receiving and stacking said first and second items, said receiving and stacking means comprising a stop finger disposed in a path of travel of said plurality of first items and means for depressing said stack of said plurality of first items and said second item, said depressing means being operable after said items have been received at said stacking and receiving means, C. means for serially feeding and counting said plurality of first items from a supply thereof to said receiving and stacking means, D. means for visually displaying the number of said first items counted by said feeding and counting means, E. means for folding a second item and for feeding said second item from a supply thereof to said receiving and stacking means, and F. means for actuating said folding means, said depressing means, and said inserting means in sequence after said first items have been counted and fed to said receiving and stacking means whereby said second item is folded and fed to said receiving and stacking means and said inserting means thereafter simultaneously inserts said stack of said plurality of first items and said second item into said envelope.

2. Apparatus as set forth in claim 1 where said means for inserting said stack of items comprises movable ram means having A. a portion thereof engageable with the upper surface of said stack of items to maintain said stack depressed during insertion thereof into said envelope, and B. a finger adjustably mounted on said ram means for engaging the rear edge of said stack of items to push said stack beyond said receiving and stacking means and into said envelope as said ram means moves toward said envelope.

3. Apparatus as set forth in claim 1 further comprising means for supporting in line said inserting means, said receiving and stacking means, said means for feeding said plurality of first items, and said means for folding and feeding a second item.

4. Apparatus as set forth in claim 1 wherein said visual display means is affixed to said second item folding and feeding means.

5. Apparatus as set forth in claim 1 further comprising means for feeding a third item from a supply thereof to said receiving and stacking means.

* * * * *